United States Patent [19]

Cafferty

[11] Patent Number: 4,637,309

[45] Date of Patent: Jan. 20, 1987

[54] METHOD OF STENCILING USING REMOVABLE PROTECTIVE COAT BEFORE APPLYING STENCIL

[76] Inventor: Terrance Cafferty, 52 Talmadge Dr., Huntington, N.Y. 11746

[21] Appl. No.: 766,191

[22] Filed: Aug. 16, 1985

Related U.S. Application Data

[63] Continuation-in-part of Ser. No. 589,024, Mar. 13, 1985, Pat. No. 4,563,948.

[51] Int. Cl.[4] ..... B24C 1/04; B24B 1/00; B30B 13/00

[52] U.S. Cl. ..... 101/129; 51/310

[58] Field of Search ..... 101/127.1, 128, 129; 51/310, 311, 312

[56] References Cited

U.S. PATENT DOCUMENTS

| | | | |
|---|---|---|---|
| 125,204 | 4/1872 | McCullagh | 101/128 |
| 4,048,918 | 9/1977 | Peck | 101/127.1 |

FOREIGN PATENT DOCUMENTS

| | | | |
|---|---|---|---|
| 34196 | 3/1979 | Japan | 51/310 |
| 65072 | 5/1980 | Japan | 51/310 |
| 66975 | 5/1980 | Japan | 51/310 |
| 15399 | 2/1981 | Japan | 51/310 |
| 107987 | 6/1984 | Japan | 51/310 |

*Primary Examiner*—Edgar S. Burr
*Assistant Examiner*—Tonya Eckstine
*Attorney, Agent, or Firm*—Roberts, Spiecens & Cohen

[57] ABSTRACT

Method of using a stencil provided with a slot straddled by a pair of tracks which accommodate a plurality of alphabetic/numeric plates having openings formed as characters. A mask is also insertable into the tracks to hold the plates in position and to conceal the abutting edges of the plates. The stencil is of a bendable material susceptible of being conformed to curves so that the stencil may be used in applications such as marking automobile parts with identification numbers. For using the above or other type of stencil, wax placed on a surface is eroded through the stencil and paint applied over the remaining wax. When the paint dries, it is wiped to remove the paint superposed on the remaining wax.

9 Claims, 14 Drawing Figures

METHOD OF STENCILING USING REMOVABLE PROTECTIVE COAT BEFORE APPLYING STENCIL

OTHER APPLICATIONS

This application is a continuation-in-part of my earlier co-pending application, Ser. No. 589,024, filed Mar. 13, 1985 and now U.S. Pat. No. 4,563,948.

FIELD OF INVENTION

This invention relates to the use of stencilling apparatus in which character plates are locked in position. The invention also relates to a method of using stencilling apparatus for vehicle part identification purposes.

BACKGROUND

Stencils have been used for a long period of time and there are a large number of patents which attest the development of different types of improved stencils and techniques for using the same. Thus, for example, the development of stencilling apparatus may be attested by U.S. Pat. Nos. 52,234; 159,725; 932,867; 1,600,177; and 4,319,524.

In U.S. Pat. No. 52,234, which was granted Jan. 23, 1866, J. Wentz shows a simple track arrangement into which are inserted plates which are perforated to bear intelligence so that a grouping of figures or letters can be readily arranged in a holder with the joints of the plates being perfectly formed and overlapping so that there is no possibility of paint working between the plates during a marking operation.

In U.S. Pat. No. 159,725, G. E. Warren also shows a stencilling arrangement wherein tracks or grooves are provided for accommodating plates bearing intelligence. These plates are held in position by the utilization of nuts and bolts cooperating with a clamping arrangement whereby the plates are prevented from shifting in position.

A more complicated stencilling apparatus appears in U.S. Pat. No. 932,867 wherein O. James shows a stencilling apparatus formed in the manner of a book comprising hinged elements. In one of these elements are provided slots through which arrangements of plates are exposed. These plates are held in position by spring-loaded wires or rods which press against the plates. The plates are otherwise held in position by incorporating projections which are accommodated in notches.

A. Hurewitz shows in U.S. Pat. No. 1,600,177 an arrangement whereby tracks or grooves are formed for receiving letter plates therein. The base element in which the tracks are formed comprises a laminar arrangement of sheets which are bound together by the projection of ears through appropriately provided slits whereby a multi-layer base element is formed in which the plates are selectively accommodated.

Developments have continued until recently as exemplified by U.S. Pat. No. 4,319,524 in which P. Dunham discloses a holder for the mounting of a plurality of stencil elements which may be readily changed. The stencil elements are provided in the form of bridges which are accommodated in notches or slots whereat they are held in position by overlying backing plates which are dimensioned to fit snugly into a recess and which are provided with apertures which register with the apertures provided in the base element.

Reference is also made to U.S. Pat. Nos. 125,204; 375,371; 2,827,721; and 4,164,183.

SUMMARY OF INVENTION

Contrary to the objectives of the aforegoing patents, it is an object of the present invention to provide for the use of a stencilling arrangement into which character plates are incorporated in such a manner that they are virtually non-movable, thus constituting a substantially permanent stencilling device, the characters of which may not be changed or at most are only changeable with substantial difficulty.

It is another object of the invention to provide for the use of an improved stencilling apparatus of the types which will constitute a permanent stencilling apparatus capable of reproducing the same intelligence.

Yet another object of the invention is to provide for the use of an improved stencilling apparatus wherein provision is made for shielding the abutting edges of adjacent character plates or elements to avoid the penetration therebetween of a stencilling fluid or of any abrasive material which might be employed in the stencilling operation.

Still another object is to provide an improved stencilling method suitable for use with the above and other types of stencilling devices.

For achieving the above and other objects of the invention, there is contemplated the use of a stencilling apparatus comprising a base member provided with an opening and including tracks on opposite sides of the opening with a plurality of plates arrangeable and extending between the tracks to obturate the opening at least in part. These plates are provided, as is known, with openings constituting indicia of intelligence including alphabetic and numeric charcters or the like. In accordance with a preferred arrangement of the invention, there is provided a mask slidable into the tracks to a position superposed on the plates. This mask is provided with windows wherethrough the openings in the plates are exposed. The mask serves also to hold the plates in position.

According to yet another aspect of the invention, there is provided a method of using the aforesaid stencilling apparatus as a stencil for an automobile having a factory vehicle identification number. This method comprises arranging the plates with the indicia therein in the tracks to constitute the aforesaid identification number. The plates are locked in the tracks with the aforesaid masks with the windows aligned with the plates. The stencilling apparatus is selectively positioned on the various parts of an automobile vehicle identification number thereby to lessen the possibility of theft.

Another aspect of the invention is that according to which a surface is covered by wax or the like which is abraded by blasting through a stencil of the aforesaid or other type following which paint or the like is applied whereafter wiping takes place.

As will be seen hereinbelow, the aforestated aspect of the invention may be viewed as a stencilling method employing a stencil with openings therein shaped to form characters, said method comprising covering a part to be stencilled with a removable substance, placing said stencil over the removeable substance, eroding the removeable substance through the stencil, applying a marking substance over the remaining removable substance and over the part where the removable substance has been eroded, and then removing the removable substance and the marking substance over the same to leave marking substance on the part to form said characters. The removable substance is preferably wax and the marking substance is preferably paint. It is also preferable that the erosion be effected by blasting an abrasive through the stencil. Such abrasive may, for example, be grit such as sand.

The above and other objects, features and advantages of the invention will be found in the detailed description which follows hereinbelow as illustrated in the accompanying drawing.

DETAILED DESCRIPTION

In accordance with the invention, provision is made for efficiently placing upon an automobile or the various parts thereof, the specific vehicle's unique factory vehicle identification number. The placement of the number is such that it is both easily readable, but subtle and not diminishing of the appearance or value of the particular part of the vehicle or of the entire vehicle. As a result, the vehicle and its thusly treated parts will become an undesirable target for theft or for illegal resale in whole or in part. Once the vehicle and its parts are so marked, a notification of the marking can be placed in a readily noticeable area thereby alerting potential thieves that the vehicle has been extensively marked with its specific vehicle identification number. The resulting loss of desirability for illegal purposes will reduce, if not eliminate, the possibility of actual theft.

In accordance with the invention, the production of a readily variable seventeen (or less) character vehicle identification number, by the use of a flexible compact stencil, is significant. It should be capable of being held against various flat or curved surfaces to enable the user to etch or otherwise place upon a metal or glass part or the like, the specific vehicle identification number. This may involve known sand blasting techniques or the daubing of a paint or the spraying of a dye or the like through the constructed stencil sequence.

Figure 1:
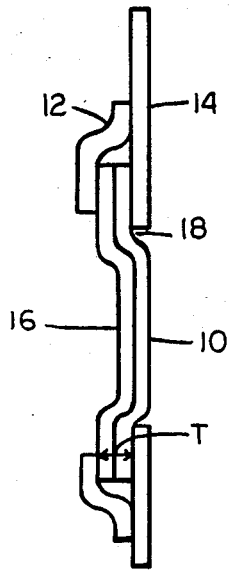
FIG. 1 is a diagrammatic cross-sectional view of a portion of a stencilling apparatus provided in accordance with the invention.

Referring next to FIG. 1, it is seen that the stencil apparatus of the invention consists of a plurality of letter tags or plates 10 held in the track 12 of a base element 14 by means of a mask 16. The function of the mask, as will be seen, is to conceal the abutting edges between adjacent plates or stencil elements while holding these elements in position, both in the track 12 and on the base element 14. More particularly, the plate 10 will be accommodated in an opening or slot 18 in the base element 14.

Figure 2:
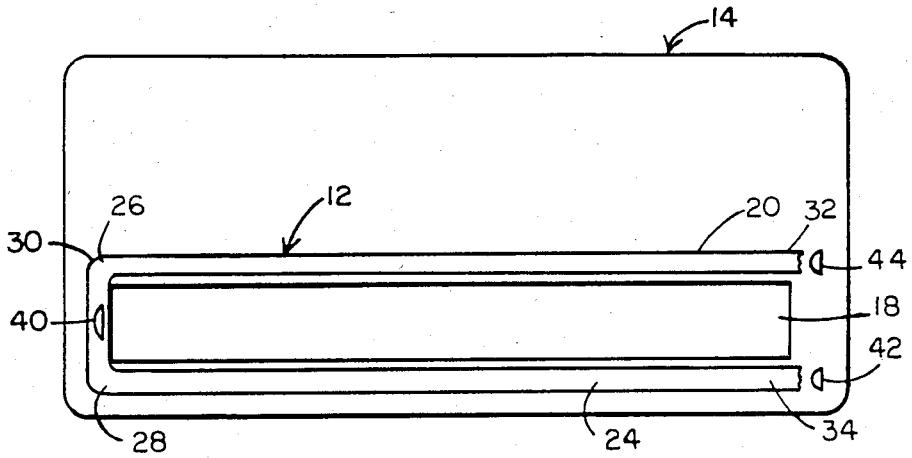
FIG. 2 is a top plan view of a base element provided in the stencilling apparatus diagrammatically illustrated in FIG. 1.
Figure 3:
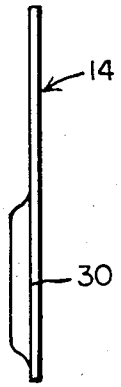
FIG. 3 is an end view of the base element of FIG. 2.
Figure 4:
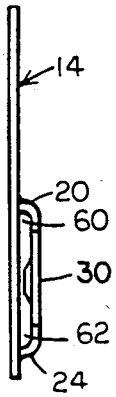
FIG. 4 is an opposite end view of the base element of FIG. 2.

FIGS. 2–4 illustrate the base element 14 of the invention. Also seen is the track 12. The track 12 consists of an upper track 20 and a lower track 24, these tracks being in parallel spaced relationship straddling the opening 18 formed in the base element 14. The tracks have first end portions 26 and 28 connected by a bridge 30. The track 12 furthermore includes second ends 32 and 34 shown partially broken away. As will be described in greater detail hereinbelow, the bridge 30 forms a closed end of the track arrangement thereby limiting the penetration of the mask and plates into the track arrangement.

The base element 14 may be fabricated of plastic or metal such as, for example, stainless steel. The material from which the base element 14, as well as the mask and plates to be described hereinafter, is made should be flexible to permit the application of the same to curved surfaces thereby enabling an effective stencilling operation to take place.

Since the preferred embodiment of the invention is one in which the plates and masks are more or less permanently inserted, the base element 14 is provided with cooperating interlocking elements to cooperate with corresponding elements on the mask whose construction will be described in greater detail hereinafter. One such interlocking element is indicated at 40 in correspondence with the first ends 26 and 28 of the track arrangement. Two additional interlocking elements are indicated at 42 and 44 in correspondence with the second or open ends 34 and 32 of the tracks 24 and 20.

Figure 5:
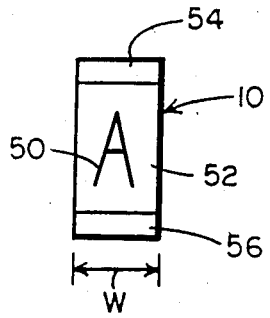
FIG. 5 is a top plan view of a character plate or element employed in conjunction with the base element of FIG. 2 in accordance with the invention.

An example of one of the plurality of plates which may be employed in accordance with the invention is illustrated in FIG. 5. Therein is shown the plate 10 bearing character 50 thereupon. This character may consist of various configurations of slots connected or spaced in known manner. The plate 10 includes a central or depressed portion 52 and two end portions 54 and 56. The end portions 54 and 56 are intended to be accommodated in the track slots 60 and 62 (see FIG. 4). This arrangement permits a plurality of plates or stencil elements to be inserted in laterally abutting relation into position whereby to expose the aggregate intelligence through the opening 18 appearing in FIG. 2.

Figure 7:
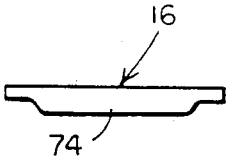
FIG. 7 is an end view of the mask of FIG. 6.
Figure 8:
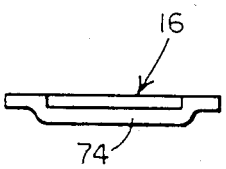
FIG. 8 is an opposite end view of the mask of FIG. 6.

To hold the plates 10 in position, as has been referred to hereinabove and has been diagrammatically illustrated in FIG. 1, there is provided the aforementioned mask 16. The details thereof appear in FIGS. 6–8. Therein it will be seen that the mask is provided with a plurality of windows 70 separated by strips 72. As the plates 10 are of equal width, the strips 72 are equally spaced. They are relatively narrow compared to the associated windows between which they intervene. The purpose of the strips 72 is to conceal the joints formed by abutting plate edges when the plates are in position. These strips and the window arrangement prevent the intrusion or penetration of abrasive material or paint or dye or the like between adjacent plates and thereby result in a much superior stencilling operation than has been heretofore possible.

The mask 16 is provided with a depressed portion 74. This depressed portion 74 is accommodated within the depressed portion 52 in each of the appropriately arranged plates. The conformation is such that a snug intermittent fit is provided as between the mask and the aggregate arrangement of plates.

Figure 6:
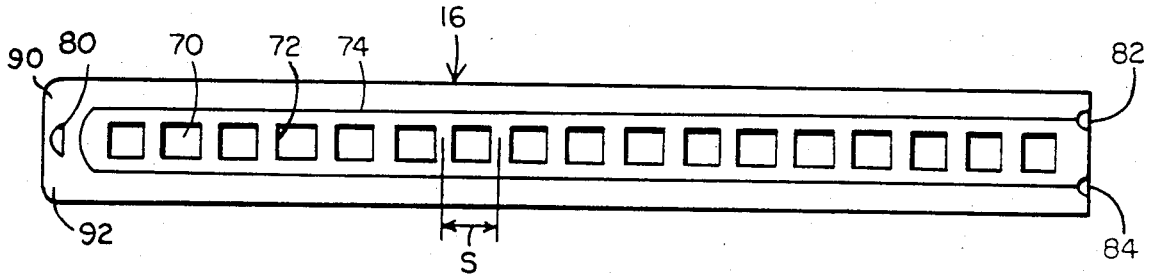
FIG. 6 is a top plan view of a masking element employed in the aforegoing stencilling apparatus.

As will be seen in FIG. 6, there are a number of interlocking elements 80,82 and 84 diagrammatically shown. These interlocking elements cooperate with the interlocking elements 40, 42 and 44 illustrated in FIG. 2. They are so constructed and arranged that when the mask 16 is inserted into the tracks 20 and 24 to the fullest depth of penetration, elements 80, 82 and 84 will engage with element 40 and elements 44 and 42 respectively. The locking engagement is a snap lock engagement which takes place in one direction of penetration while extraction of the mask 16 from engagement within the tracks 20 and 24 is substantially prevented. Such an arrangement can be provided by interlocking tongues respectively extending from the mask 16 and the base element 14. These tongues can be readily punched out of the material or formed in the material employed for these elements.

From what has been described above, it will be seen that there is provided in accordance with the invention, a stencilling apparatus employing a base member provided with an opening and including tracks on opposite sides of the opening with a plurality of plates being arrangeable in and extending between the tracks to obturate the opening at least in part. The plates are provided with openings constituting indicia of intelligence including alphabetic and numeric characters or the like. A mask is provided which is slidable into these tracks to a position in superposed relation with reslect to the plates. The mask is provided with windows wherethrough the indicia in the plates are exposed. The base member and mask cooperatively include interlocking devices to prevent detachment of the mask from the tracks. Due to these interlocking devices and the snug fit of mask 16 and plates 10 on tracks 20 and 24, the plates 10 are held in position. The interlocking devices are so constructed and arranged as to interlock when the mask is inserted to a predetermined (preferably fullest) extent into the track. Once interlocked, the interlocking elements are substantially inseparable. Thereby, once a certain intelligence or automobile vehicle identification number is formed in the stencil apparatus, it is permanent and cannot be changed without destroying the stencilling apparatus.

In the above apparatus, the opening formed in the base member is preferably an elongated slot of substantially constant width. It is preferably quadrilateral in shape. The plates include, as described above, depressed portions dimensioned to correspond to the width of the slot whereby the depressed portions are snugly accommodated in the slot. The aforesaid plates are of substantially equal width and the strips are evenly spaced (at a distance S) in correspondence with the width W of the plates thereby to conceal abutting edges between adjacent plates.

As has been noted above, the tracks include first and second ends and the mask includes ends corresponding thereto. It is to be noted that the first ends of the mask which are indicated at 90 and 92 are rounded or tapered thereby to facilitate insertion into the open ends of the tracks. It is also to be noted that the edge portions of the plates, as indicated at 54 and 56 in FIG. 5, are received in the tracks. The combined thickness T of the edge portions and the mask in aggregate are intended to provide a snug fit in the tracks. The tracks may be welded or cemented to the base element 14 of which they form a part and these tracks (in cross-section) are cantilever members thereby inherently having some degree of resilience whereby to constitute with the base elements a clamping structure wherein the mask and plates are retained. For purposes of convenience, the plates are flat, quadrilateral parts which have the aforementioned depressed central portion. The plates as well as the base member and mask are preferably of an abrasion resistant plastic or metal material to permit the utilization of an abrasive for stencilling purposes and to enable repeated use of the stencilling apparatus of the invention.

The method of the invention generally comprises using the above described apparatus, preferably as a stencil for an automobile having a factory vehicle identification number. The method specifically comprises arranging the plates with the indicia thereon in the tracks to constitute the identification number, locking the plates in the tracks by the use of the mask with the windows thereof aligned with the plates and selectively positioning the stencilling apparatus on the various parts of the automobile to act as a stencil whereby to mark the parts with the aforesaid number.

The arrangement has, as noted above, interlocking elements of a design such that any attempt to unlock or remove the mask will ruin it and the card mount thereby rendering the same useless. As has also been noted above, the mask will have a depressed portion to match that of the letter plates and a tapering of the ends of the mask will be provided to ease inserting the same into the base element.

Figure 9:
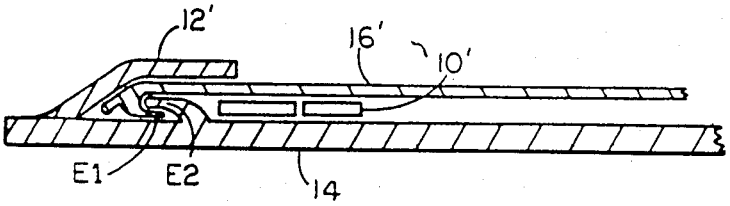
FIG. 9 is a fragmentary view partially in cross-section illustrating an interlocking arrangement employed in accordance with the invention.

In FIG. 9, the structure shown is a slight modification of what has been described above. There are numerous parts in FIG. 9 which correspond to those mentioned heretofore and such parts are identified by the same reference numbers which, however, are primed. In FIG. 9, the plates 10' are once again held in laterally abutting relation by mask 16' received in track 12'. The mask retaining arrangement is, in this case, in the form of interlocking elements E1 and E2 with E1 snapping over E2 upon installation of the mask to prevent withdrawal of the mask. This locks plates 10' in position.

FIGS. 10–14 diagrammatically illustrate a preferred method provided in accordance with the invention for use with the above and other types of stencilling apparatus. As stated hereinabove, there is provided in accordance with the invention a method which comprises placing a removable (or parting) substance on a part to be stencilled and then placing the stencilling apparatus thereon. Thereafter, the removable substance is at least partly eroded through the stencilling apparatus whereafter a marking substance is placed over the removable substance and over the part where the removable substance has been eroded. Thereafter, the removable substance and such marking substance as is placed over the same is abraded or wiped from the part with a force which enables the marking substance to remain on the part where the removable substance has been previously eroded. This permits forming the characters on the part with the marking substance. By way of preferred example, the removable substance is wax and the marking substance is paint. Any commercially available wax which is used, for example, in waxing painted surfaces of automobiles may be used. The paint may be any type of paint which will adhere to the part to be stencilled. The invention contemplates the stencilling of many different types of parts; however, preferred examples of parts which may be stencilled in accordance with the invention are hard rubber parts such as bumper parts, or painted surfaces, or the like. Metal plated surfaces may also be stencilled in accordance with the invention.

Figure 10:
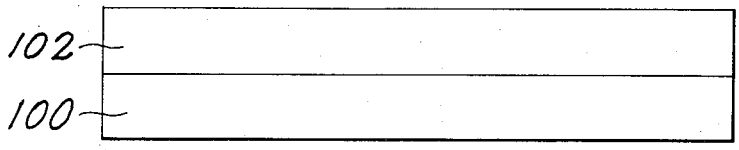
FIGS. 10–14 diagrammatically illustrate the method of the invention involving employing the aforementioned stencilling apparatus to abrade a removable or parting substance from a part to be stencilled in accordance with the invention.

Referring next to FIG. 10, there is shown therein, in diagrammatic form, a part 100 covered with a coating 102 of commercially available wax.

Figure 11:
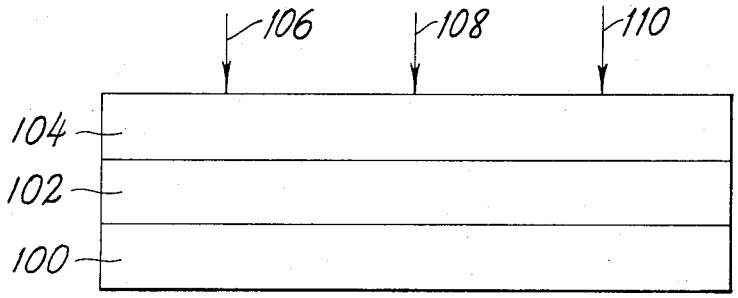
Figure 12:
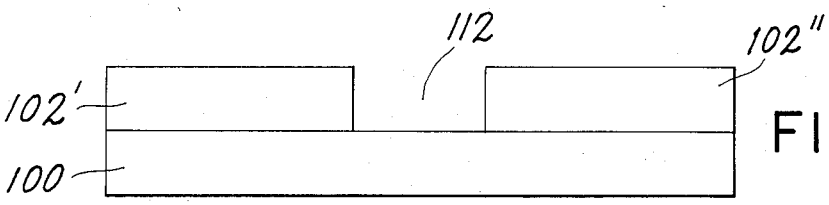
Figure 13:
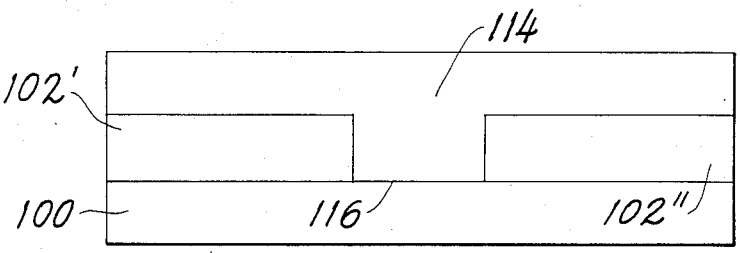

As shown in FIG. 11, the part 100 covered with wax 102 has applied, over the same, the stencilling apparatus indicated at 104. Through openings in the stencil 104, as indicated hereinabvoe in the description of FIGS. 1–9, is blasted an abrasive such as grit constituted by sand or the like. The blasting is indicated by arrows 106, 108 and 110. This leaves the wax portions 102' and 102". This also leaves openings such as indicated at 112 which in top plan view which would conform to the shapes of the various characters in the stencil.

Over the part 100 and the wax part 102' and 102", is applied a coating of paint such as indicated at 114. This paint penetrates into the opening 112 and contacts the upper surface of the part 100 as indicated at 116. It will now appear that the wax 102' and 102" constitutes a removable or parting substance relative to the part 100.

Figure 14:
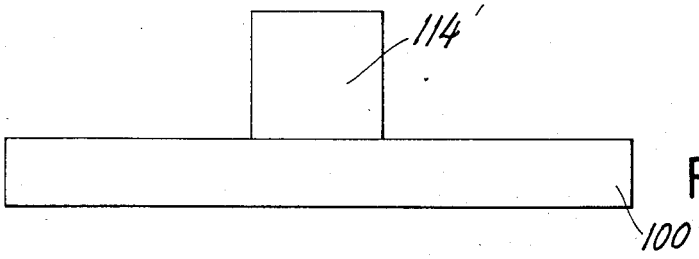

The paint is permitted to dry or set whereafter a rubbing, wiping, or abrasive action is generated by the use of a wiping rag or the like, thereby to remove from the part 100 the removable substance 102' and 102" and the paint 114 superposed above the same. This leaves a coating of marking substance such as indicated at 114' on the part 100 as illustrated in FIG. 14, thereby to form the characters which are constituted in the stencil 104. The rubbing or wiping force or other such abrading force is applied in a magnitude which permits the removal of the substances which it is desired to remove while leaving the portion 114' of the marking substance in position to form the aforementioned characters. This force is readily empirically determined since it is any normal wiping force which would enable one to remove the paint which is supported on the underlying wax while being insufficient to remove the paint forming the characters. Such force is readily visibly determined and does not require being set forth in detail in this text.

There will now be obvious to those skilled in the art many modifications and variations of the structures and methods set forth hereinabove. These modifications and variations will not depart from the scope of the invention if lying within the scope of any of the following claims or if functinally equivalent thereto.

What is claimed is:

1. A method of using a stencilling apparatus for an automobile having a factory vehicle identification number composed of characters, said method comprising arranging plates with the characters therein in tracks to constitute said identification number, said plates having abutting edges, holding the plates in the tracks with a mask having a plurality of windows separated by respective strips, aligning the windows with the plates and the strips with the abutting edges to conceal the abutting edges and to expose the plates between the strips, locking the mask and thereby the plates permanently in position, and positioning the stencilling apparatus on a part of the automobile to act as a stencil to mark said part with said number, said method further comprising placing a removable substance on said part before placing the stencilling apparatus thereon, eroding the removable substance through the stencilling apparatus, removing the stencilling apparatus, applying a marking substance over the removable substance and over the area where said removable substance has been eroded, and wiping the removable substance and marking substance from said part with a force which enables the marking substance to remain only on the area where the removable substance has been previously eroded, thereby to form said characters.

2. A method as claimed in claim 1 wherein the removable substance is wax.

3. A method as claimed in claim 2 wherein the marking substance is paint.

4. A method as claimed in claim 3 wherein the removable substance is eroded by blasting an abrasive through said stencilling apparatus.

5. A stencilling method employing a stencil with openings therein shaped to form characters, said method comprising covering a part to be stencilled with a removable substance, placing said stencil over the removable substance, eroding the removable substance through the stencil, removing the stencil, applying a marking substance over the remaining removable substance and over the area where the removble substance has been eroded, and then removing the removable substance and the marking substance over the same to leave marking substance only on the area where the removable substance was eroded to form said characters.

6. A method as claimed in claim 5 wherein the removable substance is wax.

7. A method as claimed in claim 6 wherein the marking substance is paint.

8. A method as claimed in claim 7 wherein the removable substance is eroded by blasting an abrasive through said stencil apparatus.

9. A method as claimed in claim 8 wherein the abrasive is grit.

* * * * *